US008196555B2

(12) United States Patent
Ikeda et al.

(10) Patent No.: US 8,196,555 B2
(45) Date of Patent: Jun. 12, 2012

(54) ENGINE ROOM FOR CONSTRUCTION EQUIPMENT

(75) Inventors: Toshimichi Ikeda, Kyungsangnam-do (KR); Gyeng Soo Cho, Masan-si (KR); Wook Sung Yuk, Changwon-si (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 628 days.

(21) Appl. No.: 12/402,521

(22) Filed: Mar. 12, 2009

(65) Prior Publication Data

US 2009/0235879 A1 Sep. 24, 2009

(30) Foreign Application Priority Data

Mar. 18, 2008 (KR) ..... 10-2008-0024772

(51) Int. Cl.
*F02B 77/13* (2006.01)
*F01P 7/10* (2006.01)

(52) U.S. Cl. ..... 123/41.49; 181/198; 181/200; 181/204

(58) Field of Classification Search ..... 123/41.49; 181/198, 200, 204
See application file for complete search history.

(56) References Cited

U.S. PATENT DOCUMENTS 1,843,548 A * 2/1932 Fildes ..... 454/84
3,762,489 A * 10/1973 Proksch et al. ..... 180/68.1
3,857,453 A * 12/1974 Buttke et al. ..... 180/68.1
3,923,114 A * 12/1975 Suzuki ..... 180/68.1
4,071,009 A * 1/1978 Kraina ..... 123/198 E
4,241,702 A * 12/1980 Takeuchi et al. ..... 123/41.7
4,483,412 A * 11/1984 Couturier ..... 181/204
4,503,931 A * 3/1985 Sugimoto et al. ..... 181/204
4,629,031 A * 12/1986 Kato et al. ..... 181/204
4,733,750 A * 3/1988 Poirier et al. ..... 181/202
5,042,602 A * 8/1991 Nakatani et al. ..... 180/68.1
5,816,351 A * 10/1998 Akira et al. ..... 180/68.1
5,915,365 A * 6/1999 Meisinger et al. ..... 123/527
6,167,976 B1 * 1/2001 O'Neill et al. ..... 180/69.2

(Continued)

FOREIGN PATENT DOCUMENTS

JP 11181828 A * 7/1999

*Primary Examiner* — Noah Kamen
*Assistant Examiner* — Grant Moubry
(74) *Attorney, Agent, or Firm* — Ladas & Parry LLP

(57) ABSTRACT

An engine room for construction equipment is provided, which can minimize emission of noise generated in an engine room due to driving of an engine and a ventilating fan to an outside of the engine room by absorbing the noise through a noise trap, and can improve the cooling performance of corresponding components by smoothing inhalation/discharge of an external air to/from the airtight engine room. The engine room for construction equipment includes a radiator cooling water for cooling the engine, a muffler discharging an exhaust gas from an engine to the atmosphere, a first noise trap installed in an inlet port to absorb noise generated in the engine room and emitted to an outside, a second noise trap installed in an outlet port to absorb the noise generated in the engine room and emitted to the outside, a radiator fan inhaling the external air through the first noise trap and making the inhaled external air pass through the radiator and the circumference of the engine, a discharge fan discharging the air in the engine room to the outside through the second noise trap, and an outer wall forming an airtight space for accommodating therein the engine, the muffler, the radiator fan, the hydraulic pump, and the discharge fan that generate the noise.

10 Claims, 4 Drawing Sheets

U.S. PATENT DOCUMENTS 6,405,825 B1 * 6/2002 Yabe et al. ..... 181/204
6,688,424 B1 * 2/2004 Nakada et al. ..... 181/224
6,745,860 B2 * 6/2004 Yabe ..... 180/68.1
6,922,925 B2 * 8/2005 Watanabe et al. ..... 37/466
7,047,912 B2 * 5/2006 Mimuro et al. ..... 123/41.33
7,107,943 B2 * 9/2006 Yasuda et al. ..... 123/41.62
7,129,604 B1 * 10/2006 Wang ..... 310/63
7,131,422 B2 * 11/2006 Kimura et al. ..... 123/198 E
7,201,011 B2 * 4/2007 MacDonald et al. ..... 62/259.1
7,635,048 B2 * 12/2009 Copley et al. ..... 181/204
7,861,822 B2 * 1/2011 Redmann ..... 181/204
2002/0000342 A1 * 1/2002 Yamada et al. ..... 181/204
2002/0104491 A1 * 8/2002 Izumi ..... 123/41.49

* cited by examiner

ENGINE ROOM FOR CONSTRUCTION EQUIPMENT

CROSS-REFERENCE TO RELATED APPLICATION

This application is based on and claims priority from Korean Patent Application No. 10-2008-0024772, filed on Mar. 18, 2008 in the Korean Intellectual Property Office, the disclosure of which is incorporated herein in its entirety by reference.

BACKGROUND OF THE INVENTION

1. Field of the Invention

The present invention relates to an engine room for construction equipment, which can minimize emission of noise generated in an engine room of an excavator and so on to an outside of the engine room.

More particularly, the present invention relates to an engine room for construction equipment, which can minimize emission of noise generated in an engine room due to driving of an engine and a ventilating fan to an outside of the engine room by absorbing the noise through a noise trap, and can improve the cooling performance of corresponding components by smoothing inhalation/discharge of an external air to/from the airtight engine room.

2. Description of the Prior Art

Generally, in the case of performing a work using construction equipment such as an excavator and so on, noise generated from the construction equipment (e.g. an engine, a cooling fan, a hydraulic pump, and the like) has become influential as environmental problems, and its regulations have been gradually strengthened. Particularly, as technologies for low noise have been highlighted due to the strengthening of noise regulations in Europe, there is a need to minimize the noise emission from an engine room to an outside.

As illustrated in FIG. 1, a general excavator includes a lower driving structure 1; an upper swing structure 2 mounted to swing on the lower driving structure 1 in left or right direction; a cab 3 and an engine room 4 mounted on the upper swing structure 2; a working device 11 fixed to the upper swing structure 2, and composed of a boom 6 driven by a boom cylinder 5, an arm 8 driven by an arm cylinder 7, and a bucket 10 driven by a bucket cylinder 9; and a counter weight 12 mounted on the upper swing structure 1, and provided with a built-in weight body to maintain a balance of the equipment during the operation of the equipment.

As illustrated in FIG. 2, a power generator for driving a drive part of the excavator includes an engine 13, a main hydraulic pump 15 driven by the engine 13 to supply hydraulic fluid to an actuator (e.g. a hydraulic cylinder and so on) 14 of the working device; a control valve (MCV) 16 installed in a flow path between the hydraulic pump 15 and the actuator 14 to control the flow direction of the hydraulic fluid being supplied to the actuator 14; a radiator 23 cooling an engine cooling water; an oil cooler 24 cooling the high-temperature hydraulic fluid returning from the control valve 16 to a hydraulic tank T; an auxiliary hydraulic pump 19 supplying the hydraulic fluid to a hydraulic motor 18 driving a radiator fan 17; and an auxiliary hydraulic pump 22 supplying the hydraulic fluid to a hydraulic motor 21 driving the oil cooler fan 20.

As illustrated in FIG. 3, according to a conventional engine room for construction equipment, the external air (the moving directions of which are indicated as arrows in the drawing) inhaled into the engine room through an inlet port A formed on an outer wall 27 during rotation of a radiator fan 17 is discharged to an outside through outlet ports B and C. The external air inhaled into the engine room passes through the radiator 23, and cools the engine cooling water in a tube through mutual heat exchange. The external air, having passed through the radiator 23 cools the engine body, passes through the circumference of the engine 13 to cool the engine body.

The exhaust gas discharged from the engine 13 is discharged to the atmosphere through a muffler 25. Dust and so on included in the external air inhaled into an inhalation system of the engine 13 can be filtered by an air cleaner 26.

As illustrated in FIG. 4, according to another conventional engine room for construction equipment, the engine 13 is arranged in an airtight space to prevent the noise generated in the engine room 13 from emitting out of the engine room 13. In this case, it is required to cool heat-generating components such as the radiator 23 and so on, and thus openings for circulating the external air are formed on the outer wall 27.

If the diameters of an inlet port E formed on the outer wall 27 of the engine room to inhale the external air and an outlet port D to discharge the internal air to an outside are reduced, it becomes difficult to smoothly discharge the air in the engine room to the outside. Accordingly, due to high heat generated in the engine room, a sound-absorbing material and so on installed in the engine room may catch fire.

In addition, even in the case of making the engine room airtight due to the noise generated during operation of the radiator fan 17, the noise problem cannot be basically solved. Accordingly, schemes for lowering the rotating speed of the radiator fan 17 to reduce the noise of the radiator fan 17 and to enlarge the size of the radiator fan 17 have been proposed.

The enlarged radiator fan 17 occupies much space in the engine room, and causes the manufacturing cost to be increased.

SUMMARY OF THE INVENTION

Accordingly, the present invention has been made to solve the above-mentioned problems occurring in the prior art while advantages achieved by the prior art are maintained intact.

An embodiment of the present invention relates to an engine room for construction equipment, which can reduce emission of noise generated in an engine room due to driving of an engine and a ventilating fan to an outside of the engine room by absorbing the noise through a noise trap, and can prevent corresponding components from overheating by smoothing inhalation/discharge of an external air to/from the airtight engine room.

An embodiment of the present invention relates to an engine room for construction equipment, which can solve conflicting technical problems to make an engine room airtight for noise reduction caused by engine driving and to circulate an external air through openings for cooling of heat-generating components in the engine room at low cost.

In one embodiment of the present invention, there is provided an engine room for construction equipment having an engine, a hydraulic pump connected to the engine, an inlet port inhaling an external air into an engine room, and an outlet port discharging the air in the engine room to an outside, which includes a radiator cooling water for cooling the engine; a muffler discharging an exhaust gas from the engine to the atmosphere; a first noise trap installed in the inlet port to absorb noise generated in the engine room and emitted to the outside to shield and attenuate the noise; a second noise trap installed in the outlet port to absorb the noise generated in the engine room and emitted to the outside to shield and attenuate the noise; a radiator fan inhaling the external air through the first noise trap and making the inhaled external air pass through the radiator and the circumference of the engine during rotation; a discharge fan discharging the air in the engine room to the outside through the second noise trap during rotation; and an outer wall forming an airtight space for accommodating therein the engine, the muffler, the radiator fan, the hydraulic pump, and the discharge fan that generate the noise during driving.

In another embodiment of the present invention, there is provided an engine room for construction equipment having an engine, a hydraulic pump connected to the engine, an inlet port inhaling an external air into an engine room, and an outlet port discharging the air in the engine room to an outside, which includes a radiator cooling water for cooling the engine; an oil cooler cooling hydraulic fluid discharged from the hydraulic pump; an oil cooler fan making the air in the engine room pass through the oil cooler and discharging the air having passed through the oil cooler to the outside during rotation; a muffler discharging an exhaust gas from the engine to the atmosphere; a first noise trap installed in the inlet port to absorb noise generated in the engine room and emitted to the outside to shield and attenuate the noise; a second noise trap installed in the outlet port to absorb the noise generated in the engine room and emitted to the outside to shield and attenuate the noise; a radiator fan inhaling the external air through the first noise trap and making the inhaled external air pass through the radiator and the circumference of the engine during rotation; a discharge fan discharging the air in the engine room to the outside through the second noise trap during rotation; an outer wall forming an airtight space for accommodating therein the engine, the muffler, the radiator fan, the hydraulic pump, the discharge fan, and the oil cooler fan that generate the noise during driving; and a third noise trap installed on the outer wall of the engine room to face the oil cooler, the third noise trap absorbing the noise passing through the oil cooler and being emitted to the outside to shield and attenuate the noise.

In still another embodiment of the present invention, there is provided an engine room for construction equipment having an engine, a hydraulic pump connected to the engine, an inlet port inhaling an external air into an engine room, and an outlet port discharging the air in the engine room to an outside, which includes a radiator cooling water for cooling the engine; an oil cooler cooling hydraulic fluid discharged from the hydraulic pump; an oil cooler fan making the air in the engine room pass through the oil cooler and discharging the air having passed through the oil cooler to the outside during rotation; a muffler discharging an exhaust gas from the engine to the atmosphere; a first noise trap installed in the inlet port to absorb noise generated in the engine room and emitted to the outside to shield and attenuate the noise; a radiator fan inhaling the external air through the first noise trap and making the inhaled external air pass through the radiator and the circumference of the engine during rotation; a third noise trap installed on an outer wall of the engine room to face the oil cooler, the third noise trap absorbing the noise passing through the oil cooler and being emitted to the outside to shield and attenuate the noise; a discharge fan discharging the air in the engine room to the outside through a duct during rotation; the outer wall forming an airtight space for accommodating therein the engine, the muffler, the radiator fan, the hydraulic pump, the discharge fan, and the oil cooler fan that generate the noise during driving; a fourth noise trap installed in the duct connected to the discharge fan, the fourth noise trap absorbing the noise emitted to the outside through the duct to shield and attenuate the noise; and a fifth noise trap installed on an outlet side of the duct, the fifth noise trap absorbing the noise emitted during the discharge of the exhaust gas from the muffler to the outside through the duct to shield and attenuate the noise.

An outlet port side of the muffler may be positioned in the engine room.

The radiator fan and the discharge fan may be installed in the same line so that, even if one of the radiator fan and the discharge fan becomes inoperable, the other thereof can operate to inhale and discharge the external air.

The discharge fan may be a centrifugal blower.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

Figure 1:
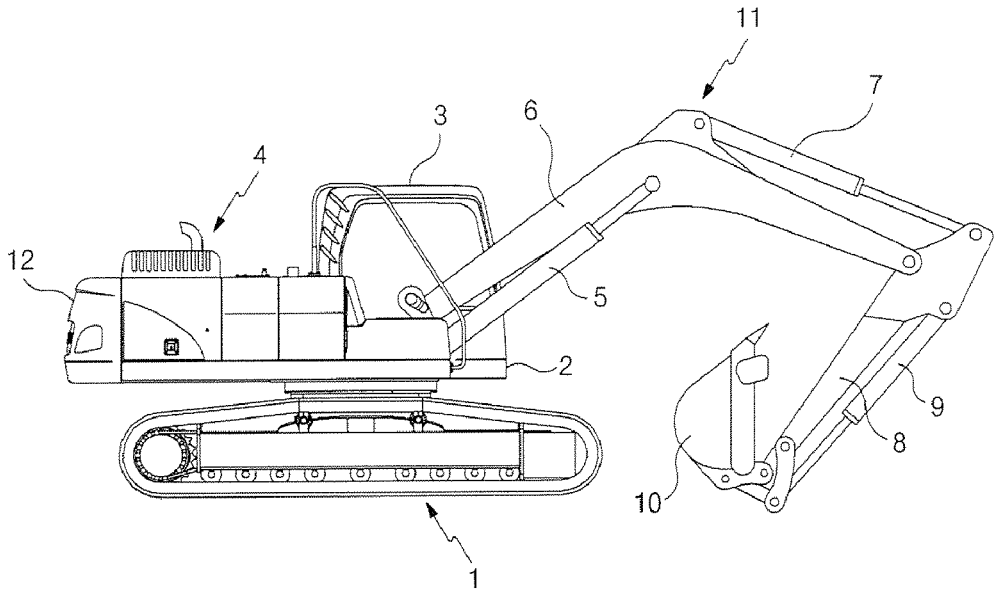
Fig. 1 Prior Art
FIG. 1 is a schematic view illustrating a general excavator.
Figure 2:
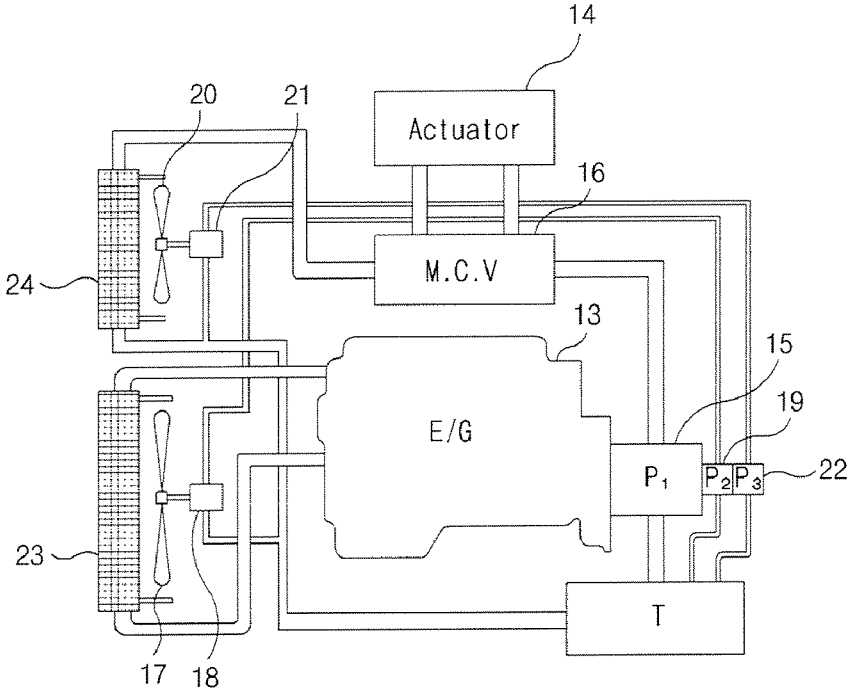
Fig. 2 Prior Art
FIG. 2 is a schematic view illustrating a power generation unit for driving a general excavator.
Figure 3:
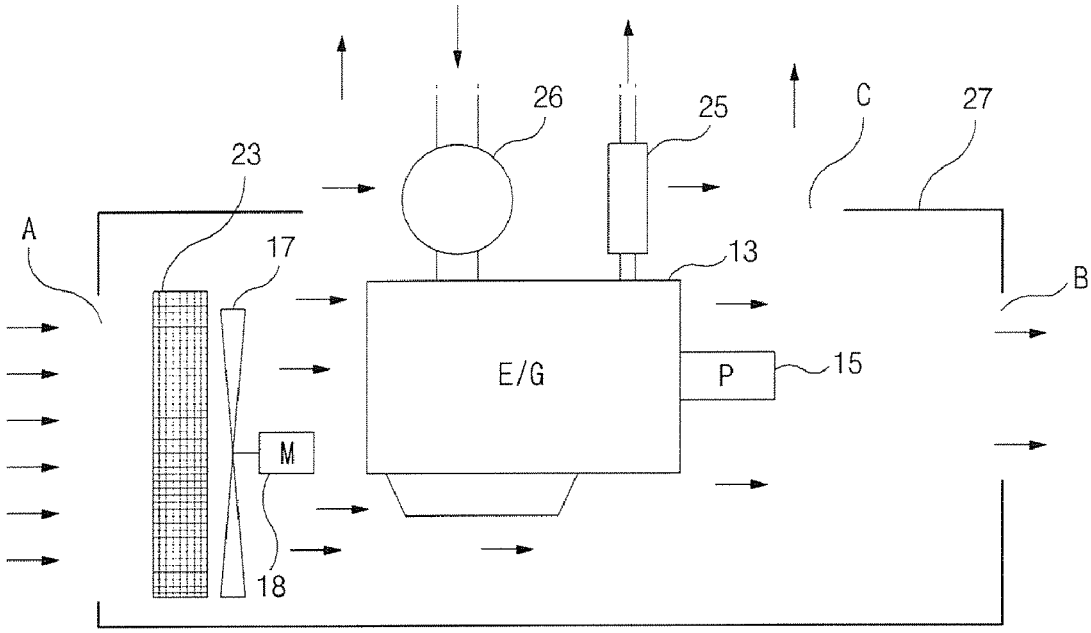
Fig. 3 Prior Art
FIG. 3 is a schematic view illustrating a conventional engine room for construction equipment.
Figure 4:
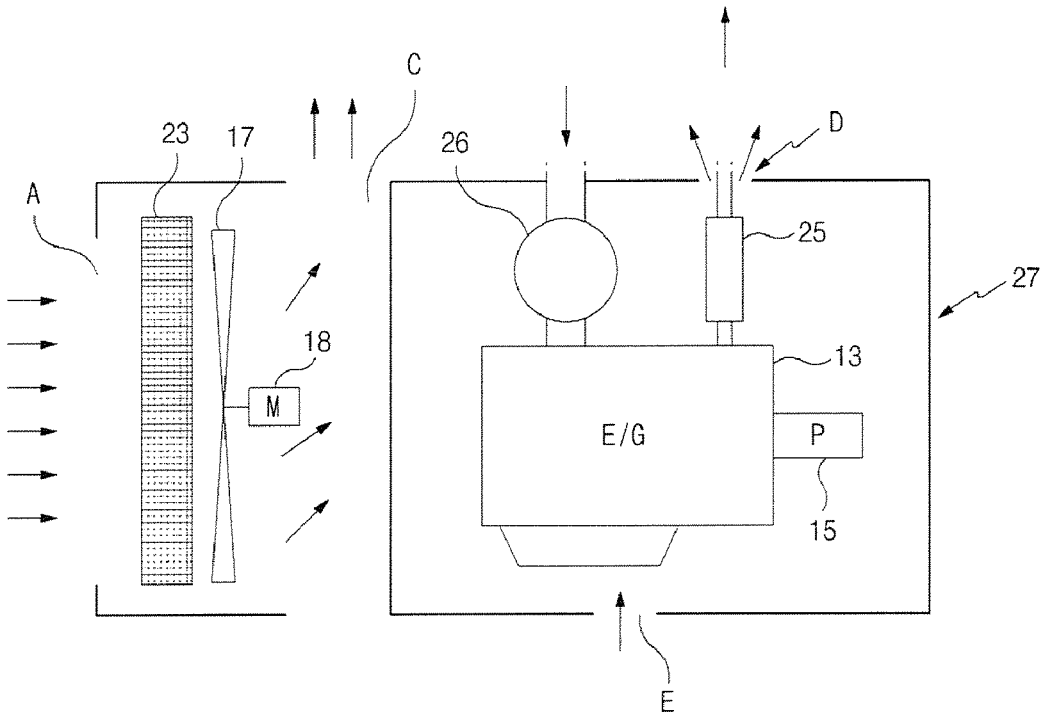
Fig. 4 Prior Art
FIG. 4 is a view explaining problems of a conventional engine room for construction equipment.
Figure 5:
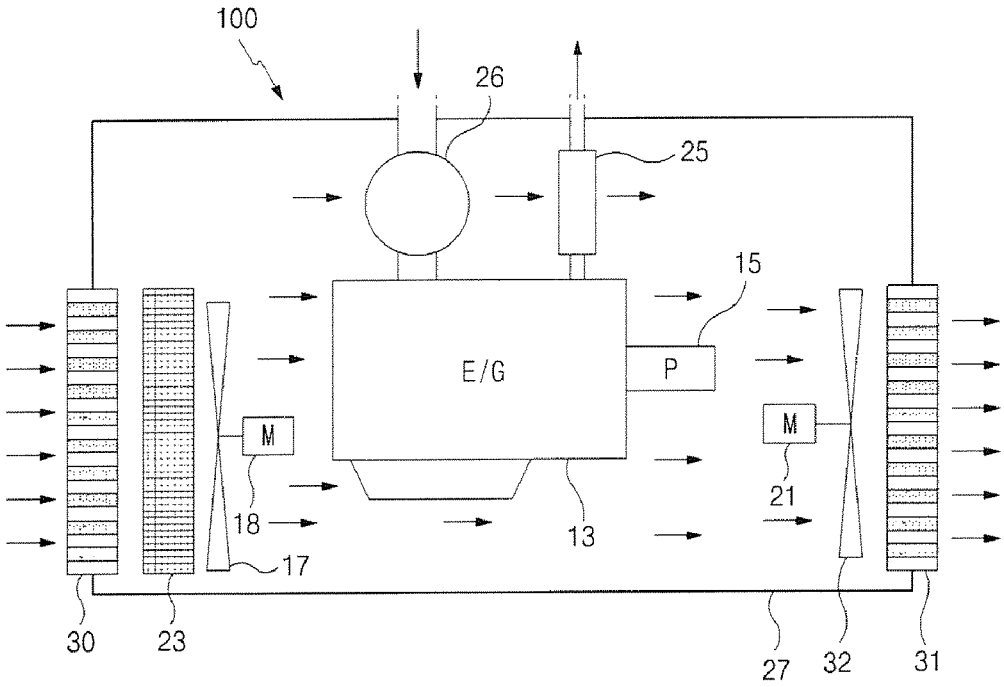
FIG. 5 is a schematic view illustrating an engine room for construction equipment according to an embodiment of the present invention.

As illustrated in FIG. 5, an engine room for construction equipment having an engine, a hydraulic pump connected to the engine, an inlet port inhaling an external air into an engine room, and an outlet port discharging the air in the engine room to an outside, includes a radiator 23 cooling water for cooling the engine 13; a muffler 25 discharging an exhaust gas from the engine 13 to the atmosphere; a first noise trap (which is used for the purpose of permitting air flow, absorbing noise generated in the engine room 100, and interfering with the air flow to intercept noise emission to an outside) 30 installed in the inlet port opposite to the radiator 23 to absorb the noise generated in the engine room 100 and emitted to the outside through a sound-absorbing material (not illustrated) made of polyurethane, glass fiber, and the like, to shield and attenuate the noise; a second noise trap 31 installed in the outlet port to absorb the noise generated in the engine room 100 and emitted to the outside to shield and attenuate the noise; a radiator fan 17 inhaling the external air into the engine room 100 through the first noise trap 30 and making the inhaled external air pass through the radiator 23 and the circumference of the engine 13 during rotation; a discharge fan 32 discharging the air in the engine room 100 to the outside through the second noise trap 31 during rotation; and an outer wall 27 forming an airtight space for accommodating therein the engine 13, the muffler 25, the radiator fan 17, the hydraulic pump 15, and the discharge fan 32 that generate the noise during driving.

Hereinafter, the operation of the engine room for construction equipment according to an embodiment of the present invention will be described in detail with reference to the accompanying drawings.

A) Reduction of the noise generated in the engine room due to engine driving through noise traps will be described.

As illustrated in FIG. 5, as the radiator fan 17 is rotated by a hydraulic motor 18 driven when the engine 13 is operated, the external air is inhaled into the engine room 100 through the first noise trap 30. The external air inhaled into the engine room 100 passes through the radiator 23 to cool the engine cooling water in the radiator 23.

The noise generated by the driving of the radiator fan 17 is absorbed by a sound-absorbing material (not illustrated) of the first noise trap 30. The air in the engine room 100 is discharged out of the engine room 100 through the second noise trap 31 by the rotation of the discharge fan 32.

That is, while the radiator fan 17 is rotated, the air from the outside is inhaled into the airtight engine room 100 only through the first noise trap 30, and while the discharge fan 32 is rotated by the driving of the hydraulic motor 21, the air in the engine room 100 is discharged out of the airtight engine room 100 only through the second noise trap 31.

Accordingly, the noise generated in the engine room 100 due to the driving of the engine 13, muffler 25, radiator fan 17, discharge fan 32, and the like, is absorbed by the sound-absorbing material of the second noise trap 32, and thus the emission of the noise generated in the airtight engine room 100 to the outside is minimized. That is, by reducing the external noise that is a public nuisance, a pleasant working environment can be produced.

On the other hand, an inlet port of an air cleaner 26 is installed outside the engine room 100 to inhale the external air as much as needed, and an outlet port of the muffler 25 is installed to project to an outside of the engine room 100.

B) Cooling of heat-generating components in the airtight engine room during engine driving will be described.

As illustrated in FIG. 5, as the radiator fan 17 is rotated by the driving of the engine 13, the external air is inhaled into the engine room 100 through the first noise trap 30. The air in the engine room 100 is discharged out of the engine room 100 through the second noise trap 31 by the rotation of the discharge fan 32.

That is, the external air is inhaled into the engine room 100 by the driving of the radiator fan 17, and the air in the airtight engine room 100 is discharged to the outside through the second noise trap 31 at high speed by the rotation of the discharge fan 32.

Accordingly, by the mutual corporation between the radiator fan 17 and the discharge fan 32, the air in the engine room 100 is efficiently circulated, and thus the cooling of the heat-generating components in the engine room 100 can be improved.

On the other hand, even if anyone of the radiator fan 17 and the discharge fan 32 becomes inoperable due to trouble during operation, the other fan that normally operates can inhale and discharge the external air. Accordingly, the equipment is prevented from stopping its operation, and can continuously perform the work having a small load.

An engine room for construction equipment having an engine, a hydraulic pump connected to the engine, an inlet port inhaling an external air into an engine room, and an outlet port discharging the air in the engine room to an outside according to another embodiment of the present invention, except for an oil cooler 24, an oil cooler fan 20, and a third noise trap 33, is substantially the same as the engine room according to the embodiment of the present invention as illustrated in FIG. 5, and thus the detailed description thereof will be omitted. In the description of the present invention, the same drawing reference numerals are used for the same elements across various figures.

Figure 6:
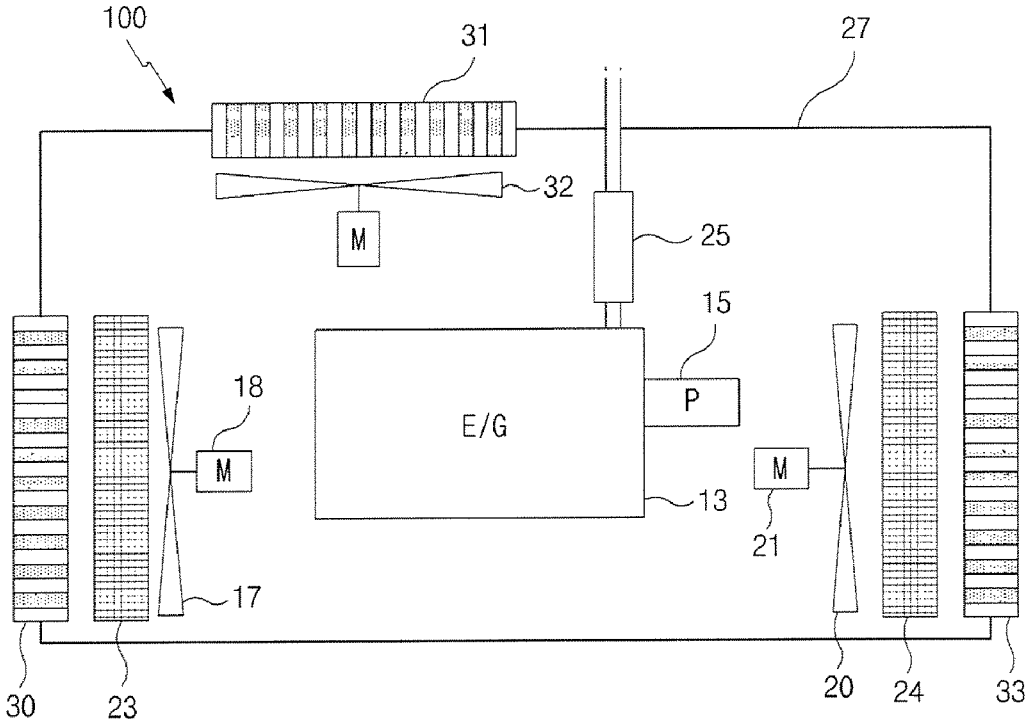
FIG. 6 is a schematic view illustrating an engine room for construction equipment according to another embodiment of the present invention.

As illustrated in FIG. 6, the engine room for construction equipment according to another embodiment of the present invention includes a radiator 23 cooling water for cooling the engine 13; an oil cooler 24 cooling hydraulic fluid discharged from the hydraulic pump 15; an oil cooler fan 20 making the air in the engine room 100 pass through the oil cooler 24 and discharging the air having passed through the oil cooler 24 to the outside during rotation; a muffler 25 discharging an exhaust gas from the engine 13 to the atmosphere; a first noise trap 30 installed in the inlet port opposite to the radiator 23 to absorb noise generated in the engine room 100 and emitted to the outside to shield and attenuate the noise; a second noise trap 31 installed in the outlet port to absorb the noise generated in the engine room 100 and emitted to the outside to shield and attenuate the noise; a radiator fan 17 inhaling the external air through the first noise trap 30 and making the inhaled external air pass through the radiator 23 and the circumference of the engine 13 during rotation; a discharge fan 32 discharging the air in the engine room 100 to the outside through the second noise trap 31 during rotation; an outer wall 27 forming an airtight space for accommodating therein the engine 13, the muffler 25, the radiator fan 17, the hydraulic pump 15, the discharge fan, 32 and the oil cooler fan 20 that generate the noise during driving; and a third noise trap 33 installed on the outer wall 27 of the engine room 100 to face the oil cooler 24, the third noise trap 33 absorbing the noise passing through the oil cooler 24 and being emitted to the outside to shield and attenuate the noise.

In this case, the discharge fan 32 and the second noise trap 31 may be installed on an upper part of the second noise trap 31 or on a side surface of the outer wall 27.

Accordingly, the oil cooler 24 is cooled by the oil cooler fan 20 that is rotated by the driving of the hydraulic motor 21 during the driving of the engine 13, and thus the high-temperature hydraulic fluid returning from the hydraulic pump 15 to the hydraulic tank can be cooled. In this case, the noise generated during the driving of the oil cooling fan 20 is absorbed by the sound-absorbing material of the third noise trap 33, and thus the emission of the noise to the outside can be intercepted.

An engine room for construction equipment having an engine, a hydraulic pump connected to the engine, an inlet port inhaling an external air into an engine room, and an outlet port discharging the air in the engine room to an outside according to still another embodiment of the present invention, except for a muffler 25 having an outlet port installed in the engine room 100, is substantially the same as the engine room according to another embodiment of the present invention as illustrated in FIG. 6, and thus the detailed description thereof will be omitted. In the description of the present invention, the same drawing reference numerals are used for the same elements across various figures.

Figure 7:
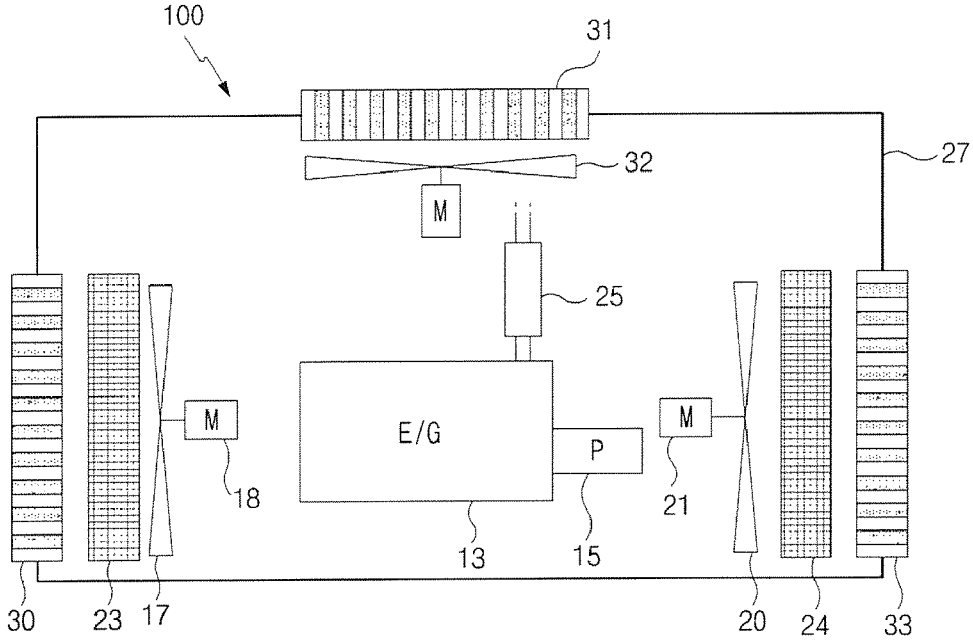
FIG. 7 is a schematic view illustrating an engine room for construction equipment according to still another embodiment of the present invention.

The engine room for construction equipment according to still another embodiment of the present invention as illustrated in FIG. 7 includes a radiator 23 cooling water for cooling the engine 13; an oil cooler 24 cooling hydraulic fluid discharged from the hydraulic pump 15; an oil cooler fan 20 making the air in the engine room 100 pass through the oil cooler 24 and discharging the air having passed through the oil cooler 24 to the outside during rotation; a muffler 25 discharging an exhaust gas from the engine 13 to the atmosphere, the muffler 25 having an outlet port installed in the engine room 100; a first noise trap 30 installed in the inlet port opposite to the radiator 23 to absorb noise generated in the engine room 100 and emitted to the outside to shield and attenuate the noise; a second noise trap 31 (which is formed of a material having durability against the high-temperature exhaust gas discharged from the muffler 25) installed on an outer wall 27 of the engine room 100 opposite to the outlet port of the muffler 25 to absorb the noise emitted to the outside to shield and attenuate the noise; a radiator fan 17 inhaling the external air through the first noise trap 30 and making the inhaled external air pass through the radiator 23 and the circumference of the engine 13 during rotation; a discharge fan 32 discharging the air in the engine room 100 to the outside through the second noise trap 31 during rotation; the outer wall 27 forming an airtight space for accommodating therein the engine 13, the muffler 25, the radiator fan 17, the hydraulic pump 15, the discharge fan, 32 and the oil cooler fan 20 that generate the noise during driving; and a third noise trap 33 installed on the outer wall 27 of the engine room 100 to face the oil cooler 24, the third noise trap 33 absorbing the noise passing through the oil cooler 24 and being emitted to the outside to shield and attenuate the noise.

Accordingly, the large noise discharged from the muffler 25 is discharged inside the engine room 100, and thus the noise emitted to the outside of the engine room 100 can be reduced. That is, by discharging the air in the engine room 100 to the outside through the second noise trap 31 by the discharge fan 32, the noise discharged from the muffler 25 is attenuated and vanished in the airtight engine room 100.

An engine room for construction equipment having an engine, a hydraulic pump connected to the engine, an inlet port inhaling an external air into an engine room, and an outlet port discharging the air in the engine room to an outside according to still another embodiment of the present invention, except for a centrifugal blower type discharge fan 36, a duct 37, fourth and fifth traps 38 and 39 installed in the duct 37, is substantially the same as the engine room according to another embodiment of the present invention as illustrated in FIG. 6, and thus the detailed description thereof will be omitted. In the description of the present invention, the same drawing reference numerals are used for the same elements across various figures.

Figure 8:
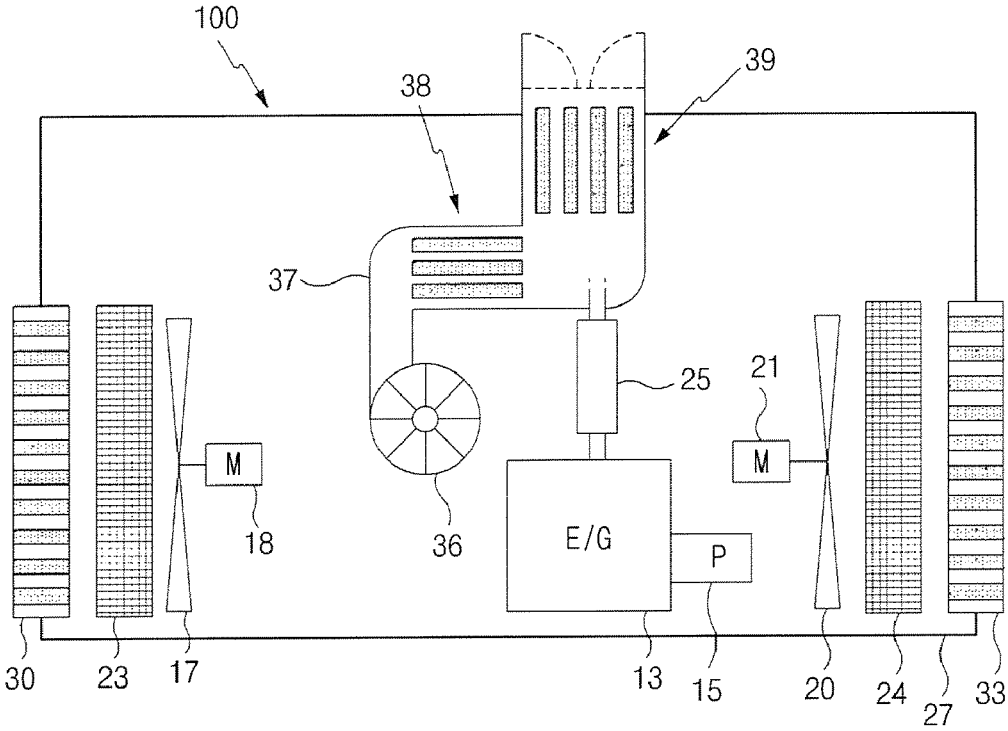
FIG. 8 is a schematic view illustrating an engine room for construction equipment according to still another embodiment of the present invention.

The engine room for construction equipment according to still another embodiment of the present invention as illustrated in FIG. 8 includes a radiator 23 cooling water for cooling the engine 13; an oil cooler 24 cooling hydraulic fluid discharged from the hydraulic pump 15; an oil cooler fan 20 making the air in the engine room 100 pass through the oil cooler 24 and discharging the air having passed through the oil cooler 24 to the outside during rotation; a muffler 25 discharging an exhaust gas from the engine 13 to the atmosphere; a first noise trap 30 installed in the inlet port opposite to the radiator 23 to absorb noise generated in the engine room 100 and emitted to the outside to shield and attenuate the noise; a radiator fan 17 inhaling the external air through the first noise trap 30 and making the inhaled external air pass through the radiator 23 and the circumference of the engine 13 during rotation; a third noise trap 33 installed on an outer wall of the engine room 100 to face the oil cooler 24, the third noise trap 33 absorbing the noise passing through the oil cooler 24 and being emitted to the outside to shield and attenuate the noise; a discharge fan 36 discharging the air in the engine room 100 to the outside through a duct 37 during rotation; the outer wall 27 forming an airtight space for accommodating therein the engine 13, the muffler 25, the radiator fan 17, the hydraulic pump 15, the discharge fan 36, and the oil cooler fan 20 that generate the noise during driving; a fourth noise trap 38 installed in the duct 37 connected to the discharge fan 36, the fourth noise trap 38 absorbing the noise emitted to the outside through the duct 37 to shield and attenuate the noise; and a fifth noise trap 39 (which is formed of a material having durability against the high-temperature exhaust gas discharged from the muffler 25) installed on an outlet side of the duct 17, the fifth noise trap 39 absorbing the noise emitted during the discharge of the exhaust gas from the muffler 25 to the outside through the duct 37 to shield and attenuate the noise.

In this case, a centrifugal blower may be used as the discharge fan 36.

Accordingly, the air in the engine room 100 is discharged to the outside through the duct 37 by the centrifugal blower type discharge fan 36. At this time, the noise in the engine room 100 is absorbed by the sound-absorbing material of the fourth and fifth noise traps 38 and 39 installed in the duct 37 to be attenuated and shielded, and thus the emission of the noise out of the engine room 100 can be intercepted.

Also, the high-temperature exhaust gas discharged from the muffler 25 is discharged to the outside through the fifth noise trap 39 installed on the outlet side of the duct 37. At this time, the noise discharged from the muffler 25 is absorbed by the sound-absorbing material of the fifth noise trap 39 to be attenuated and shielded, and thus the emission of the noise to the outside can be intercepted.

As described above, the engine room for construction equipment according to the embodiments of the present invention has the following advantages.

As the noise generated in the engine room during driving of the engine is shielded by the noise traps and the emission of the noise out of the engine room is reduced, a pleasant working environment can be produced. Also, the inhalation/discharge of the external air to/from the airtight engine room is smoothly performed, and thus a fire caused by overheating of corresponding components can be prevented.

In addition, conflicting technical problems to reduce the noise due to the engine driving and to circulate the external air through openings for cooling of heat-generating components in the engine room can be solved at low cost, and thus the price competitiveness can be improved.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. An engine room for construction equipment having an engine, a hydraulic pump connected to the engine, an inlet port inhaling an external air into an engine room, and an outlet port discharging the air in the engine room to an outside, the engine room comprising:

a radiator cooling water for cooling the engine;

an oil cooler cooling hydraulic fluid discharged from the hydraulic pump;

an oil cooler fan making the air in the engine room pass through the oil cooler and discharging the air having passed through the oil cooler to the outside during rotation;

a muffler discharging an exhaust gas from the engine to the atmosphere;

a first noise trap installed in the inlet port to absorb noise generated in the engine room and emitted to the outside to shield and attenuate the noise;

a second noise trap installed in the outlet port to absorb the noise generated in the engine room and emitted to the outside to shield and attenuate the noise;

a radiator fan inhaling the external air through the first noise trap and making the inhaled external air pass through the radiator and the circumference of the engine during rotation;

a discharge fan discharging the air in the engine room to the outside through the second noise trap during rotation;

an outer wall forming an airtight space for accommodating therein the engine, the muffler, the radiator fan, the hydraulic pump, the discharge fan, and the oil cooler fan that generate the noise during driving; and a third noise trap installed on the outer wall of the engine room to face the oil cooler, the third noise trap absorbing the noise passing through the oil cooler and being emitted to the outside to shield and attenuate the noise;

wherein the muffler has an outlet port side that is installed in the engine room.

2. The engine room of claim 1, wherein the engine room is mounted on an excavator of the construction equipment.

3. The engine room according to claim 1, wherein the outer wall comprises first and second opposing end wall portions and first and second opposing side wall portions, the first and second side wall portions being disposed between and connecting the first and second opposing end wall portions, wherein the first noise trap is disposed along the first end wall portion facing the radiator and the radiator fan, the second noise trap is disposed along the first side wall portion facing the discharge fan and the third noise trap is disposed along the second end wall portion facing the oil cooler and the oil cooler fan.

4. The engine room of claim 3, wherein the engine room is mounted on an excavator of the construction equipment.

5. An engine room for construction equipment having an engine, a hydraulic pump connected to the engine, an inlet port inhaling an external air into an engine room, and an outlet port discharging the air in the engine room to an outside, the engine room comprising:

a radiator cooling water for cooling the engine;

an oil cooler cooling hydraulic fluid discharged from the hydraulic pump;

an oil cooler fan making the air in the engine room pass through the oil cooler and discharging the air having passed through the oil cooler to the outside during rotation;

a muffler discharging an exhaust gas from the engine to the atmosphere;

a first noise trap installed in the inlet port to absorb noise generated in the engine room and emitted to the outside to shield and attenuate the noise;

a radiator fan inhaling the external air through the first noise trap and making the inhaled external air pass through the radiator and the circumference of the engine during rotation;

a third noise trap installed on an outer wall of the engine room to face the oil cooler, the third noise trap absorbing the noise passing through the oil cooler and being emitted to the outside to shield and attenuate the noise;

a discharge fan discharging the air in the engine room to the outside through a duct during rotation;

the outer wall forming an airtight space for accommodating therein the engine, the muffler, the radiator fan, the hydraulic pump, the discharge fan, and the oil cooler fan that generate the noise during driving;

a third noise trap installed in the duct connected to the discharge fan, the third noise trap absorbing the noise emitted to the outside through the duct to shield and attenuate the noise; and a fourth noise trap installed on an outlet side of the duct, the fourth noise trap absorbing the noise emitted during the discharge of the exhaust gas from the muffler to the outside through the duct to shield and attenuate the noise, wherein the discharge fan is a centrifugal blower.

6. The engine room of claim 5, wherein the engine room is mounted on an excavator of the construction equipment.

7. The engine room according to claim 5, wherein the outer wall comprises first and second opposing end wall portions and first and second opposing side wall portions, the first and second side wall portions being disposed between and connecting the first and second opposing end wall portions, wherein the first noise trap is disposed along the first end wall portion facing the radiator and the radiator fan, the second noise trap is disposed along the second end wall portion facing the oil cooler and the oil cooler fan, and the discharge fan discharges the air to the outside above the first side wall.

8. The engine room of claim 7, wherein the engine room is mounted on an excavator of the construction equipment.

9. An engine room for construction equipment having an engine, a hydraulic pump connected to the engine, an inlet port inhaling an external air into an engine room, and an outlet port discharging the air in the engine room to an outside, the engine room comprising:

a radiator cooling water for cooling the engine;

an oil cooler cooling hydraulic fluid discharged from the hydraulic pump;

an oil cooler fan making the air in the engine room pass through the oil cooler and discharging the air having passed through the oil cooler to the outside during rotation;

a muffler discharging an exhaust gas from the engine to the atmosphere;

a first noise trap installed in the inlet port to absorb noise generated in the engine room and emitted to the outside to shield and attenuate the noise;

a radiator fan inhaling the external air through the first noise trap and making the inhaled external air pass through the radiator and the circumference of the engine during rotation;

a second noise trap installed on an outer wall of the engine room to face the oil cooler, the second noise trap absorbing the noise passing through the oil cooler and being emitted to the outside to shield and attenuate the noise;

a discharge fan discharging the air in the engine room to the outside through a duct during rotation;

the outer wall forming an airtight space for accommodating therein the engine, the muffler, the radiator fan, the hydraulic pump, the discharge fan, and the oil cooler fan that generate the noise during driving;

a third noise trap installed in the duct connected to the discharge fan, the third noise trap absorbing the noise emitted to the outside through the duct to shield and attenuate the noise; and a fourth noise trap installed on an outlet side of the duct, the fourth noise trap absorbing the noise emitted during the discharge of the exhaust gas from the muffler to the outside through the duct to shield and attenuate the noise, wherein the outer wall comprises first and second opposing end wall portions and first and second opposing side wall portions, the first and second side wall portions being disposed between and connecting the first and second opposing end wall portions, wherein the first noise trap is disposed along the first end wall portion facing the radiator and the radiator fan, the second noise trap is disposed along the second end wall portion facing the oil cooler and the oil cooler fan, and the discharge fan discharges the air to the outside above the first side wall.

10. The engine room of claim 9, wherein the engine room is mounted on an excavator of the construction equipment.

* * * * *